US006279361B1

(12) United States Patent
Baukholt et al.

(10) Patent No.: US 6,279,361 B1
(45) **Date of Patent: *Aug. 28, 2001**

(54) LOCK IN PARTICULAR FOR MOTOR VEHICLE DOORS

(75) Inventors: Theo Baukholt; Alfred Wipfler, both of Kriftel; Jens Lübben, Rastede, all of (DE)

(73) Assignee: VDO Adolf Schindling AG, Frankfurt (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/165,024

(22) Filed: Sep. 30, 1998

Related U.S. Application Data

(63) Continuation-in-part of application No. 08/744,206, filed on Nov. 5, 1996, now abandoned.

(30) Foreign Application Priority Data

Sep. 30, 1998 (DE) ..... 19547724

(51) Int. Cl.[7] ..... E05B 47/00
(52) U.S. Cl. ..... 70/279.1; 292/201
(58) Field of Search ..... 70/262–264, 256, 70/257, 277–279; 292/201, 336.3, 199, 216

(56) References Cited

U.S. PATENT DOCUMENTS

| | | | | |
|---|---|---|---|---|
| 4,569,544 | * | 2/1986 | Escaravage | 292/216 |
| 4,588,217 | * | 5/1986 | Escaravage | 292/201 |
| 4,624,491 | * | 11/1986 | Vincent | 292/201 |
| 4,762,348 | * | 8/1988 | Matsumoto | 292/201 |
| 4,763,936 | * | 8/1988 | Rogakos et al. | 292/201 |
| 4,948,183 | * | 8/1990 | Yamada | 292/216 X |
| 5,577,782 | * | 11/1996 | Johnson et al. | 292/201 X |
| 5,582,448 | * | 12/1996 | Inoue | 292/201 X |
| 5,667,259 | * | 9/1997 | Torkowski | 292/201 |
| 5,680,783 | * | 10/1997 | Kuroda | 292/201 X |
| 5,697,236 | * | 12/1997 | Kleefeldt et al. | 292/201 X |
| 5,785,364 | * | 7/1998 | Kleefeldt et al. | 292/201 |

FOREIGN PATENT DOCUMENTS

0589158 A1 3/1994 (EP) .

* cited by examiner

*Primary Examiner*—Suzanne Dino Barrett
(74) *Attorney, Agent, or Firm*—Martin A. Farber

(57) ABSTRACT

A lock, suitable for use in a car door, has a rotary latch which cooperates with a locking wedge, or the like, and can be locked by a locking pawl in a locking position. The pawl is actuatable by a setting device for bringing the rotary latch at least into an open position. In order to provide a lock which is of improved efficiency and is both compact in construction and operates reliably, transmission elements are arranged between the pawl and the setting device for transmitting movement of the setting device, in stepped-down fashion, to the pawl.

14 Claims, 9 Drawing Sheets

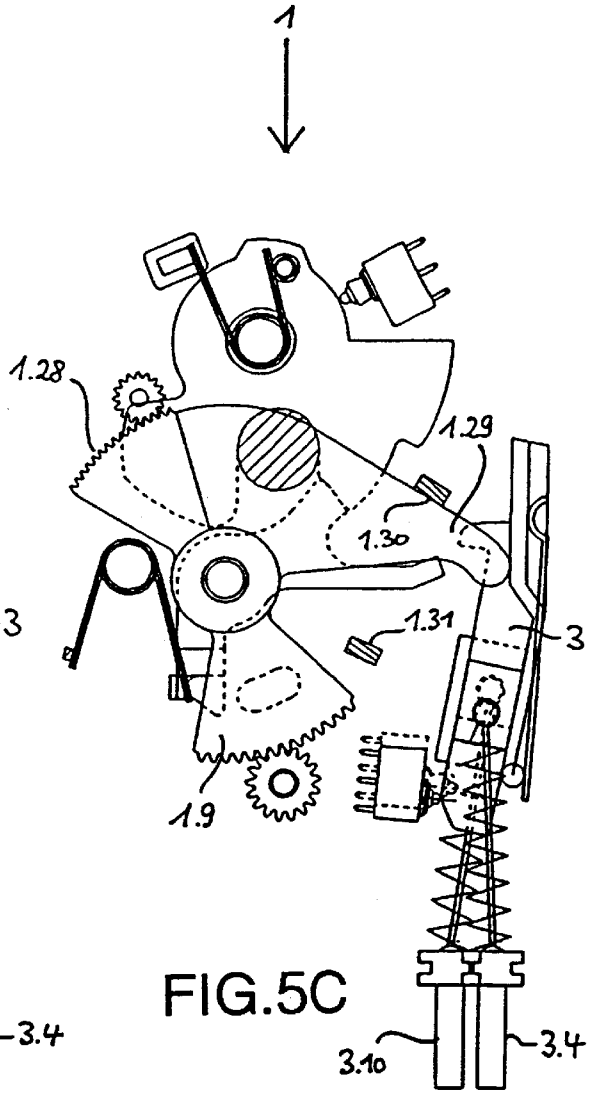
FIG.5A
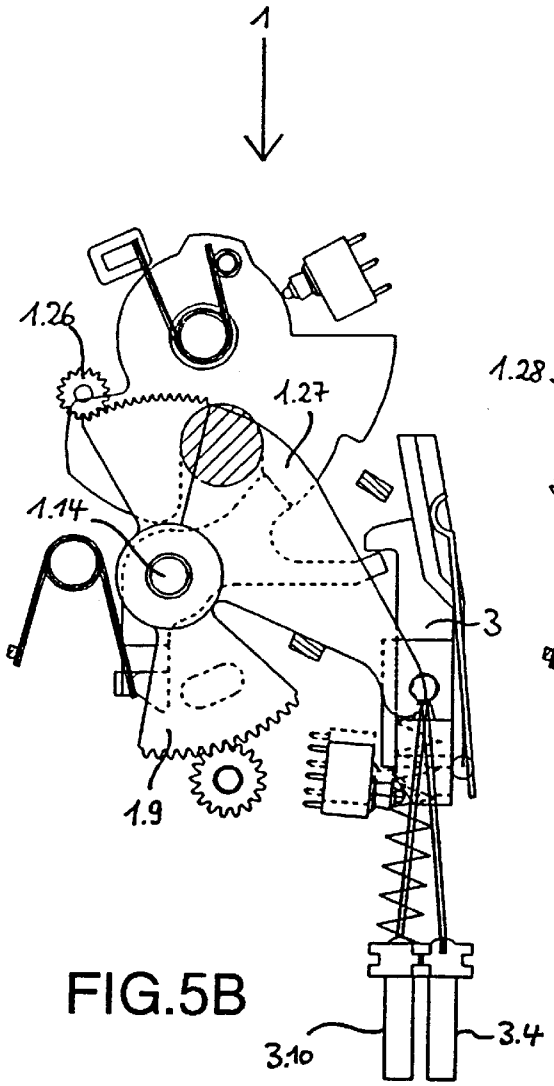
FIG.5B
FIG.5C

LOCK IN PARTICULAR FOR MOTOR VEHICLE DOORS

This application is a continuation-in-part of Ser. No. 08/744,206 filed Nov. 5, 1996, abd.

FIELD AND BACKGROUND OF THE INVENTION

The present invention relates to a lock, in particular a lock for car doors, having a rotary latch (1.1) which cooperates with a locking wedge (1.5), or the like, and can be locked by a pawl (1.3) in a locking position, the pawl being actuatable by a setting device, and the pawl bringing the rotary latch at least into one open position.

Such a lock is known from European Patent Application 0 589 158 A1, which has a rotary latch which cooperates with a closure bolt or the like and is locked in a locking position by a pawl. A manipulator (door handle) is connected by an electric line to a motorized setting drive which, upon actuation of the handle, acting with a displaceable setting member on the pawl, moves the pawl into its unlocked position when a switch arranged in the electric line is brought into active position by a corresponding switch command of a receiving device or a device connected therewith. The motorized setting drive is an electromagnet having a displaceable iron core as actuator which, however, requires a large structural space since large setting forces are necessary in order to move the pawl out of the locking position into the unlocked position. Furthermore, there is the disadvantage that a high control expense is necessary in order to position the actuator in its two desired positions. Furthermore, a setting drive which is adapted to the forces is cost-intensive.

SUMMARY OF THE INVENTION

It is an object of the invention to provide a lock of improved efficiency, compact construction, and reliable operation.

According to the invention, transmission elements which transmit the movement of the setting device, in stepped-down fashion, to the pawl are arranged between the pawl (1.3) and the setting device.

They, furthermore, have the advantage that a setting device can be used which requires little construction space and is therefore of compact construction. Furthermore, the movement brought about by the setting device (for instance, rotary or linear movement) is stepped-down by the transmission elements so that a sufficiently high moment of rotation of the setting device for the actuating of the pawl is established, so that the pawl reliably locks the rotary latch in the locking position or moves it into the open position or releases the pre-stressed rotary latch.

As a further development of the invention, the transmission elements constitute a step-down transmission which is advantageously developed as a gear wheel transmission. This has the advantage that the step-down transmission operates reliably and, furthermore, precise adjustment paths are made possible. Since the rotary latch, can be brought or released by the pawl from a locking position into an open position or vice versa, the movement of the pawl in both directions of movement is carried out dependably and accurately.

As a further development of the invention, the step-down transmission has at least one gear wheel (1.8) driven by an electric motor (1.7) which forms the setting device, and at least one toothed segment (1.9) connected with the gear wheel (1.8) for actuating the pawl (1.3). In this way there is indicated a structural development for the step-down transmission which is compact in construction and operates reliably, since the components indicated can be integrated within the lock, in particular, in the door of the motor vehicle.

As a further development of the invention, in order to increase the moment of rotation between the drivable gear wheel (1.8) and the toothed segment (1.9), at least one additional toothed segment (1.10) having two gear wheels or toothed segments of different diameter arranged one above the other are provided, the gear wheel or toothed segment 1.10*a* having the larger diameter being associated with the gear wheel (1.8) and the gear wheel toothed segment 1.10*b* having the smaller diameter being associated with the toothed segment (1.9). In this way a further stepping-down of the motion (rotation) of the setting device (electric motor) is established, as a result of which the moment of rotation and thus the reliable actuation of the pawl is further increased.

In a further development of the invention, a sensor (rotary-latch switch 1.11) for detecting the position of the rotary latch (1.1) is associated at least with the rotary latch (1.1). This has the advantage that the setting device, released by the device at least for the giving of setting commands, is actuated until the rotary latch reaches the open position and the setting device is disconnected when this open position is reached. The same is true of the locking position, i.e. the setting device is moved in the other direction of movement until the rotary latch is moved from the open position into the locking position. This return travel is possible also when the rotary latch is already open.

As a further development of the invention, the pawl (1.3) can be brought by the setting device, in particular by the toothed segment (1.9) which is movable by the setting device, into at least one further predeterminable position, or locked therein. This has the advantage that, for instance, the door of the motor vehicle does not open immediately upon an opening command but is brought into a disengaged position (pre-detent) and stopped there, in which position the door is then opened completely by a further opening command (two-stroke opening). It is also conceivable to skip the predeterminable position by a longer opening command so that the door is opened directly by the opening command. Conversely, this, however, can also mean that, upon the closing of the door, if the closing pressure was not sufficiently great, the door stops initially in the disengaged position and is either pressed closed by strong pressing or must first of all be again opened before the final closed position (locked position of the rotary latch) is then reached.

As a further aspect of the invention, a control device (1.10) for the lock has, for the giving of setting commands, an input device (10.7) (such as a switch for the actuation of a child-proof door catch) and/or a receiver (10.8) with which there is associated at least one portable transmitter (10.9) for the giving of setting commands. In this way, the opening or closing commands can be transmitted by remote control to the lock so that the latter operates purely electrically and a mechanical aid in closing such as a lock cylinder can be dispensed with. For the establishing of further setting possibilities for the setting device, an input device is provided, which, when it has been actuated, for instance by the door inside handle, can be actuated without this bringing about a movement of the setting device.

As a further development of the invention, a manipulator (for example, a door inside handle or door outside handle)

and an actuation-detection device (for instance a switch) associated with the manipulator form a structural unit. This has the advantage that, as customary up to now, a manipulator is provided, for instance, on the outside of the door of the motor vehicle and on the inside, a switch being integrated in the manipulator and thus the two forming a single structural unit. It is also conceivable for the switch to be connected with the manipulator by transmission elements at least over a small distance.

As a further development of the invention, the switch is actuated, without actuation of the manipulator and/or without contact. This has the advantage that the actuating of the switch can be effected while bypassing the manipulator which is advantageous, in particular, in the case of an emergency. For this purpose it can be provided, for instance, that a recess or an opening is present in the door of the vehicle through which the switch can be actuated, possibly by means of a suitable tool. In order to avoid the closing of a switch, and possibly of the manipulator, the actuating of the switch takes place without contact or without actuation by force, the switch being developed for this purpose as a sensitive sensor. This sensor which acts for instance inductively or capacitively is thus merely contacted or approached and from this contact an actuation of the setting device is brought about in the event that the switch or the sensor is switched in active position.

The lock of the invention can be preferably used in doors, car trunks, gas-tank caps or glove compartments of motor vehicles, but the invention is not limited to this field and other fields of use are possible.

BRIEF DESCRIPTION OF THE DRAWINGS

With the above and other objects and advantages in view, the present invention will become more clearly understood in connection with the detailed description of preferred embodiments, when considered with the accompanying drawings, of which:

FIGS. 5A–5F show stages in the operation of a lock with mechanical redundancy in accordance with a third embodiment;

FIG. 5G is a detailed view of FIG. 5D; and

DETAILED DESCRIPTION OF THE PREFERRED EMBODIMENTS

Figure 1B:
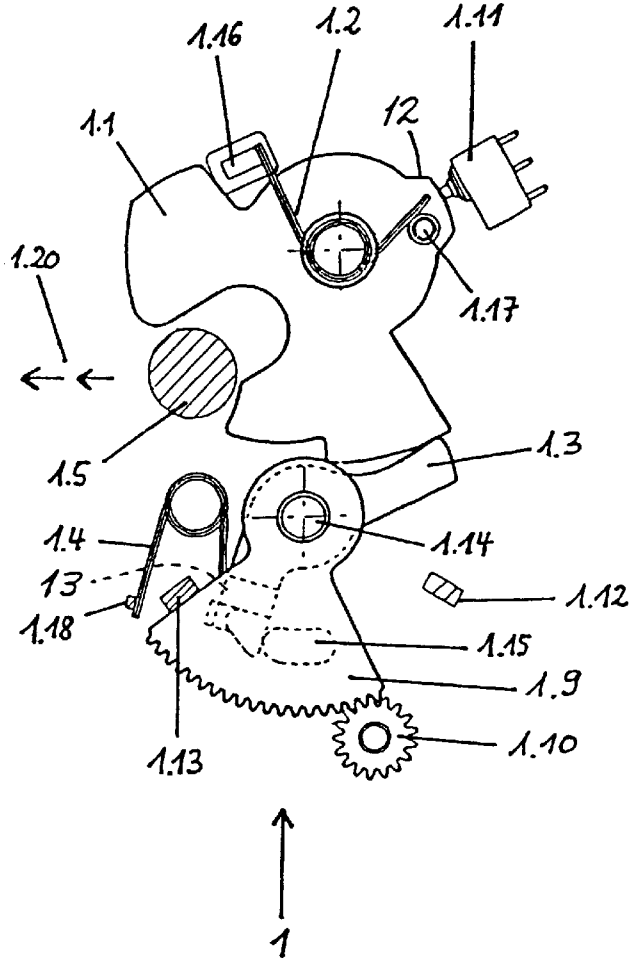
FIG. 1B is a view of a lock in its open position.

A lock shown in FIG. 1 has a rotary latch 1.1 which acts against a rotary-latch spring 1.2. The rotary latch 1.1 is held in the locked position shown in this figure by a pawl 1.3 which acts against a pawl spring 1.4. The U-shaped rotary latch 1.1 by its two arms surrounds a locking wedge 1.5 and thus, in known manner, holds a car door for instance in its closed position. The above-indicated parts as well as the following parts are mounted on a lock plate 1.6, in which connection this lock plate 1.6 can also represent a housing which can be easily, simply and in space-saving manner mounted, for instance, within the door of the motor vehicle.

Figure 1A:
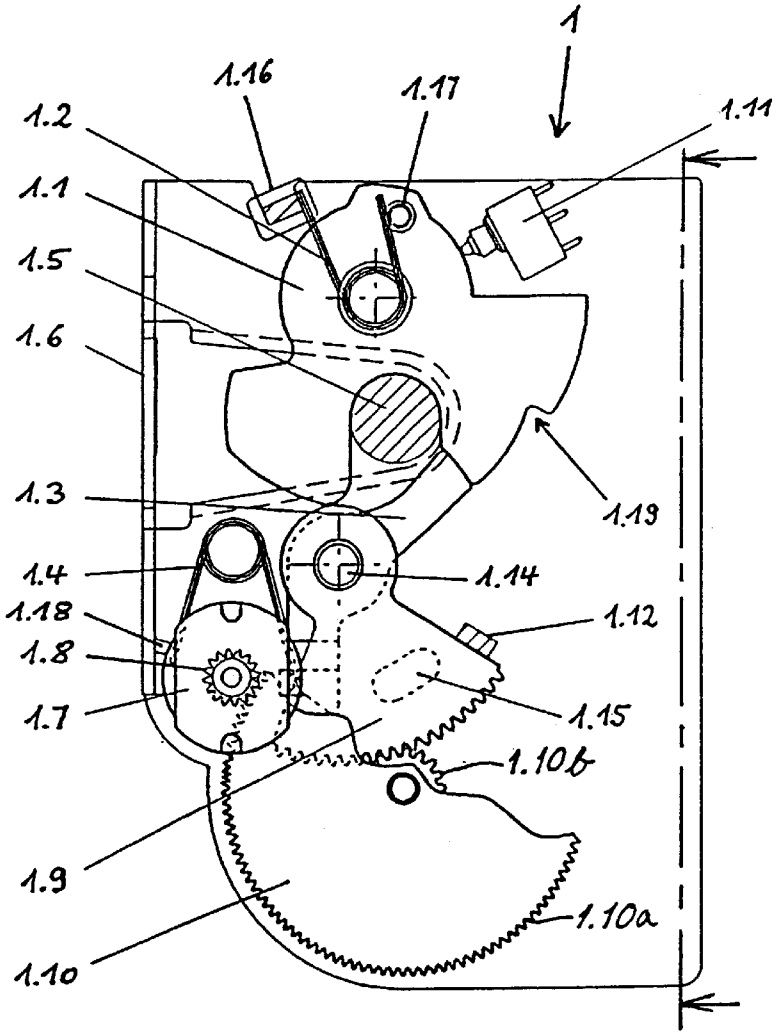
FIG. 1A is a view of a lock in its locked position.

The setting device is developed as an electric motor 1.7 on the output shaft of which there is a pinion 1.8 which can mesh with a toothed segment which then acts on the pawl 1.3. In FIG. 1A, on the other hand, it is shown that a toothed segment 1.9 acting on the pawl 1.3 is connected via the toothed segment 1.10 to the pinion 1.8. In this case, the pinion 1.8 meshes with a large gear wheel 1.10*a* of the toothed segment 1.10 to the pinion 1.8, the toothed segment 1.10 having, on the same shaft, a smaller gear wheel 1.10*b* which meshes with the toothed segment 1.9. In this way, the bi-directional movement of the electric motor 1.7 is converted and stepped-down so as to actuate the pawl 1.3. For the detection of the position of the rotary latch 1.1, a rotary-latch switch 1.11 is provided which, is actuated by a projection 12 on the rotary latch 1.1 when the latter has reached its open position, as shown in FIG. 1B.

As further components, the lock 1 has stops 1.12 and 1.13 which limit the end positions of the toothed segment 1.9. In the event that the toothed segment 1.9 strikes against one of the stops 1.12 or 1.13, and the electric motor 1.7 is also connected, a slip clutch (not shown) can be provided at a suitable point between the electric motor 1.7 and the toothed segment 1.9 prevents overload and thus damage to or destruction of the elector motor 1.7.

In the embodiment shown in FIG. 1A, the pawl 1.3 and the toothed segment 1.9 are rotatable independently of each other around a pivot point 1.14 so that a driver 1.15 is associated with the toothed segment 1.9, it striking, upon actuation of the electric motor 1.7, against an arm 13 of the pawl 1.3, carrying the latter along with it, thus releasing the rotary latch 1.1. The rotary latch 1.1, upon its release, moves automatically into the open position since the rotary latch spring 1.2 is arranged between two stops 1.16 and 1.17. In the same manner, the locking pawl 1.3 is spring-loaded by the pawl spring 1.4, the pawl spring resting on the one hand against the arm 13 of the pawl 1.3 and, on the other hand, against a stop 1.18. In this way, upon actuation of the pawl 1.3, the rotary latch 1.1 is directly released. Furthermore, the rotary latch 1.1 has a shoulder 1.19 in which the pawl 1.3 can, but need not, initially engage in a first stroke position of the door, and then, after further movement by the electric motor 1.7, releases the rotary latch 1.1 in its open position, (second position of the door shown in FIG. 1B, whereby a two-stroke release position 1.20 of the vehicle door is made possible.

Figure 2:
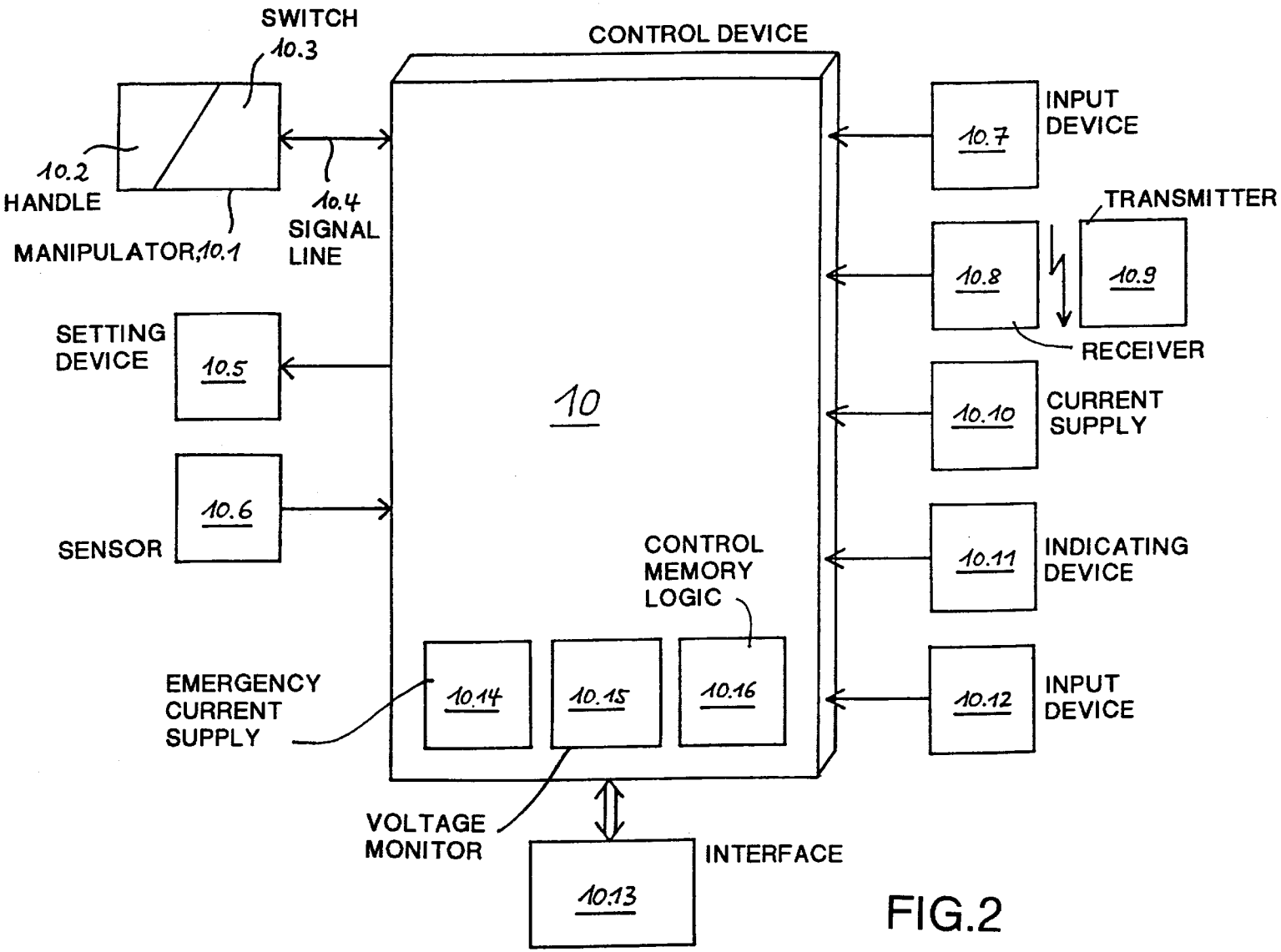
FIG. 2 is a block diagram of a control device.

FIG. 2 shows a control device 10 by which the electric motor 1.7 (FIGS. 1A–1B) is controlled as a function of opening and closing commands. With the control device 10 there is associated at least one manipulator 10.1 which has a handle 10.2 as well as a switch 10.3 (both shown diagrammatically) which are arranged for instance in each case on the inside and outside of the motor vehicle door. The switch 10.3 is connected via a signal line 10.4 with the control device 10, in which connection, in the event of more than one car door, several manipulators 10.1 can also be present. Furthermore, the control device 10 is connected with a setting device 10.5 (in particular, the electric motor 1.7), the control device 10 receiving information as to the position of the rotary latch 1.1 via a sensor 10.6 (comprising the rotary-latch switch 1.11). Furthermore, the control device 10 has, associated with it, an input device 10.7 (for instance a switch for the activating and deactivating of a child-proof device) as well as a receiver 10.8, in which connection opening and closing commands can be transmitted via a transmitter 10.9 to the receiver 10.8. Furthermore, the control device 10 has, associated with it, an electric current supply 10.10, an indicating device 10.11 (for the status indication), as well as another input device 10.12 (for special functions, as will be explained further below). In addition, the control device 10 can be provided with an interface 10.13 via which given functions can be established via which further information with regard to the status of the vehicle can be transmitted to the control device 10. An emergency current supply 10.14 and a voltage monitor 10.15, which for instance activates the emergency current supply 10.14 when a predetermined voltage threshold is dropped below, are integrated in the control device 10. Both of the components 10.14 and 10.15 can be present, but need not be. By the reference numeral 10.16 there is indicated an input and output control as well as a control-and-memory-logic, with which, for instance, stored in a program, the functions of the control device are carried out.

The control device 10 operates as follows:

First of all, let us assume that the switch 10.3 (and possibly also the other switches) are deactivated so that actuation of the manipulator 10.1 does not produce any movement of the setting device 10.5. This means that the car doors are closed, and thus an anti-theft device is connected. If the driver of the vehicle, for instance, desires the opening of at least one door or the actuation of the entire central locking system, he actuates the transmitter 10.9 or, for instance, also the other input device 10.12, it being so developed that it can be actuated only under certain conditions with which the driver is, for instance, acquainted. This can, for instance, be the entering of a numerical code. After this entry of actuating of the transmitter 10.9, the switch or switches 10.3 are switched into active position so that then, after actuation of the handle 10.2, the setting device 10.5 is actuated, i.e. the electric motor 1.7 is connected until the rotary latch 1.1 is released into its open position by the pawl 1.3 (or until the pawl 1.3 comes against the shoulder 1.9 which can be recognized by another sensor).

When the rotary latch 1.1 (FIGS. 1A–1B) has reached its open position, this is recognized by the sensor 10.6 (rotary-latch switch 1.11), and the control device 10.5 is disconnected. After the recognition of the open position, a reversal in direction of rotation of the electric motor 1.7 advantageously takes place so that the toothed segment moves back into the position shown in FIG. 1A and the pawl 1.3 is pressed by the pawl spring 1.4 against the rotary latch 1.1. Thereby, when the door is closed, that is the locking wedge 1.5 is pressed into the rotary latch 1.1, the spring-loaded pawl 1.3 holds the rotary latch 1.1 after a "snapping" into its locking position. As an alternative, it is conceivable also to provide a sensor for detecting the position of the locking wedge 1.5, so that, when it has reached a position such as shown substantially in FIG. 1A, the pawl 1.3 is moved into the locking position via the toothed segments 1.9 and 1.10. For this purpose, in the embodiment shown, the pawl 1.3 would be connected firmly to the toothed segment 1.9.

Based on the construction shown in FIGS. 1A and 1B, constructions in accordance with the invention are shown in FIGS. 3A to 5F and described below. This applies in the event that, for instance, the manufacturer of a motor vehicle desires mechanical redundance and/or this is required on basis of provisions of the law.

FIGS. 3A–3F show the lock 1 which, in addition to the components already shown and described, which may possibly be modified in an easily recognizable manner, has an outer lever 2 which is connected to a door outside handle or else to a lock cylinder arranged in the outside region of the vehicle. The outer lever 2 has a nose 2.1 which can be operatively connected with the lever arm 1.22 of the pawl 1.3. Via a rod 2.2 or other transmission elements, the outer lever 2 is connected with the door outside handle or the closure cylinder and carries out substantially a linear movement in a direction of movement 2.3. If the outer lever 2 is actuated, the pawl 1.3 is thereby moved from its locking position into the opening position, so that the door opens.

Figures 3A, 3B, 3C:
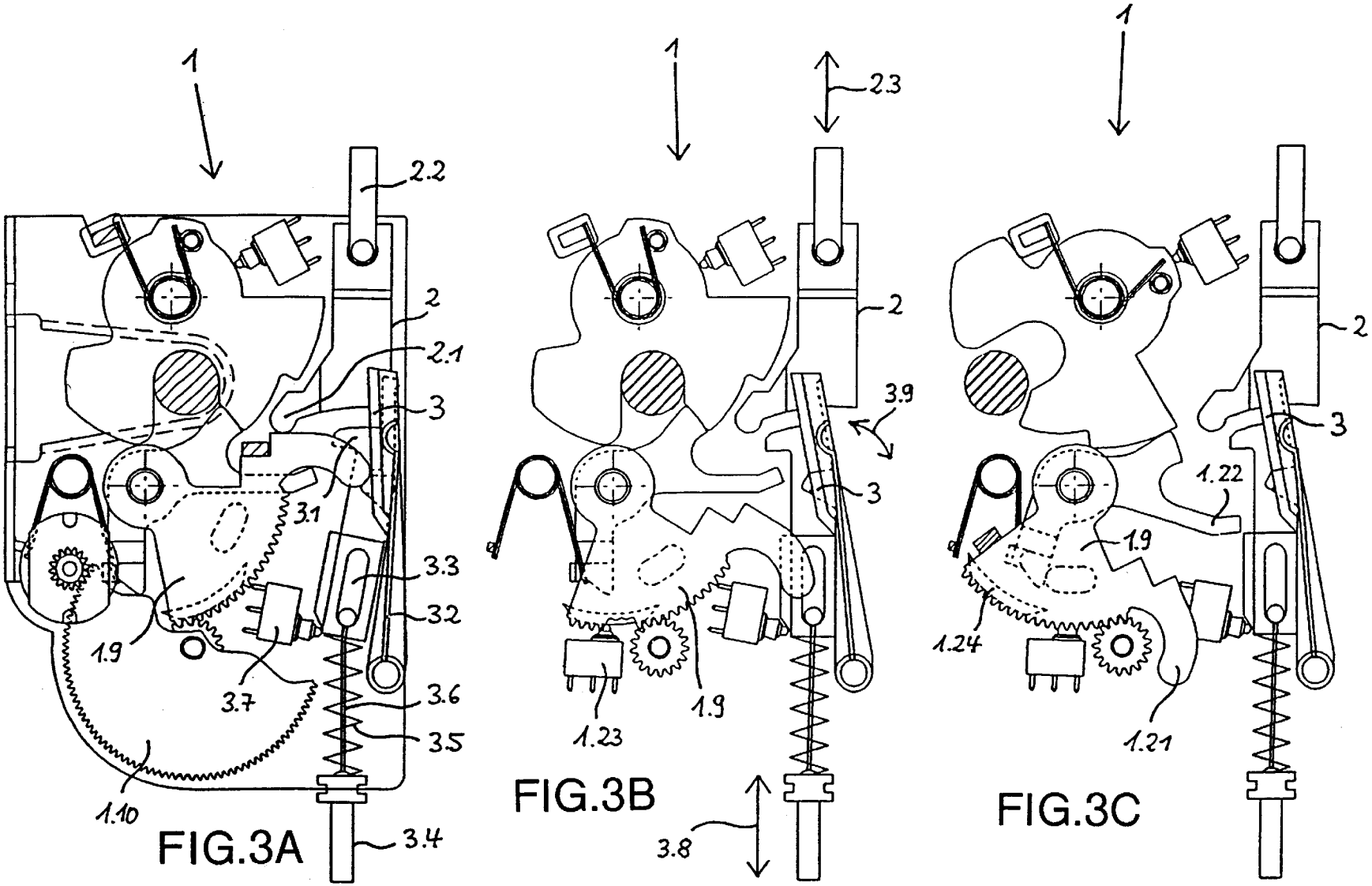
FIGS. 3A to 3F show stages in the operation of a lock with mechanical redundancy in accordance with a first embodiment of the invention.

Furthermore, an inner lever 3, connected for instance with a door inside handle, is integrated in the lock 1. The inner lever 3 also has a nose 3.1 which can be operatively connected with the lever arm 1.22. The inner lever 3 is displaceable linearly on a resting part, not further designated in this figure, such part being urged via a spring 3.2 and being swingable around a pivot point, also not further designated. The inner lever 3 has a slot 3.3 which receives the end of a core 3.6, pre-tensioned by a spring 3.5, in a Bowden cable 3.4. For the detecting and evaluating of the movement of the inner lever 3 there is provided an inner lever switch 3.7 which is actuated when the inner lever 3 is moved in a direction of movement 3.8. As shown in FIG. 3B with respect to FIG. 3A, the inner lever 3 carries out a coupling moment 3.9 when the inner lever 3 is released from the nose 1.21 of the toothed segment 1.9.

Figure 3F:
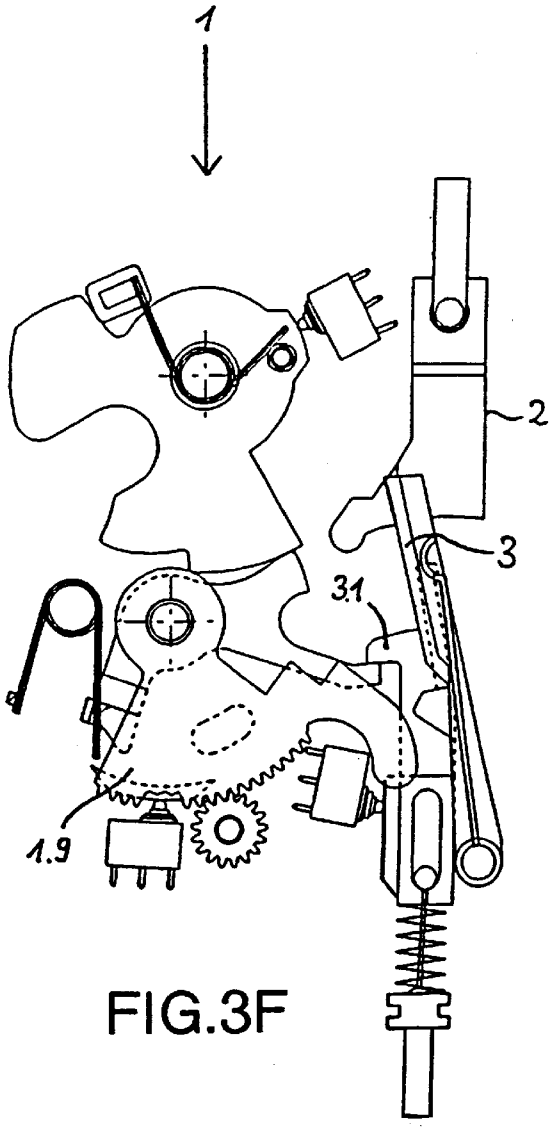
Figure 3E:
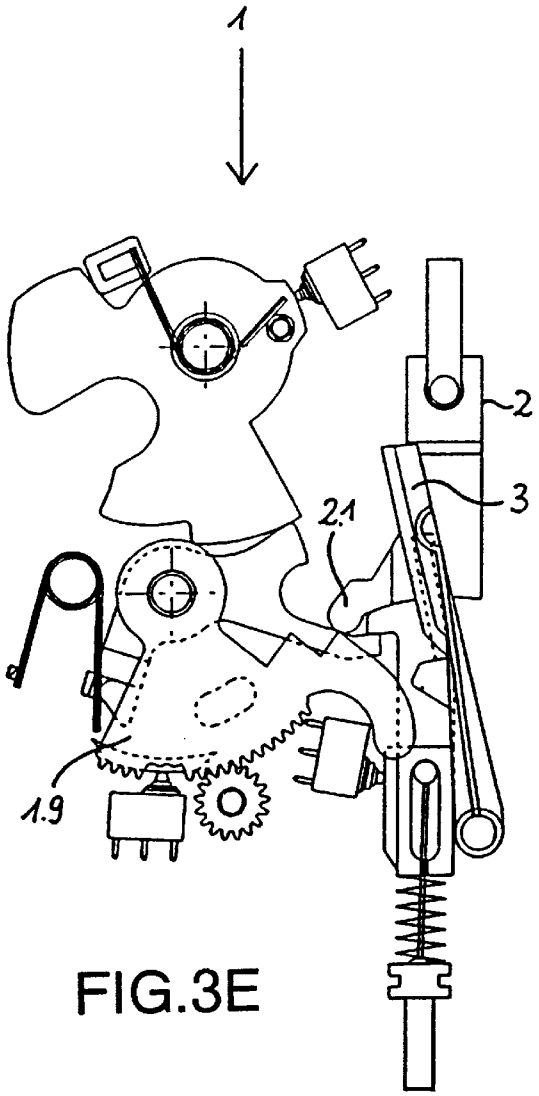
Figure 3D:
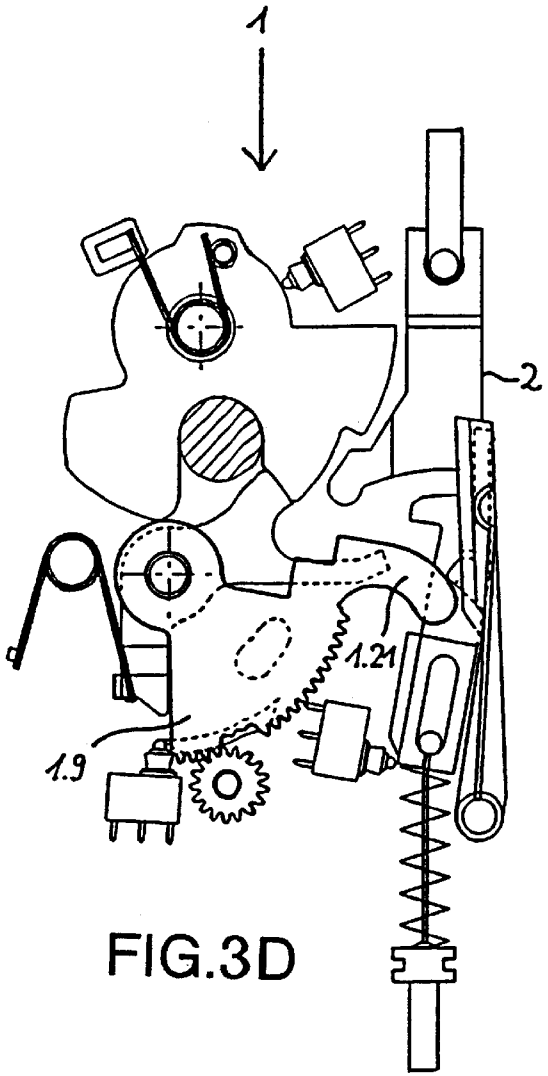

In FIG. 3A, neither the outer lever 2 nor the inner lever 3 is operatively connected with the lever arm 1.22, so that the lock cannot be opened either by the door inside handle or by the door outside handle. Therefore, this corresponds to an anti-theft position. FIG. 3B shows a preparatory position, in which the pawl 1.3 can be brought into an open position on the basis of an opening command by the motor 1.7, which position is then shown in FIG. 3C. FIG. 3D shows a position of the toothed segment 1.9 in which the lock 1 can be opened by actuation of the outer lever 2, while the inner lever 3 is brought out of engagement with the lever arm 1.22. FIG. 3E shows the case that the outer lever 2 has been actuated, as a result of which its nose 2.1 comes to rest against the lever arm 1.22, swings the arm around the pivot point 1.14 and thus releases the rotary latch 1.1. This opens the door. FIG. 3F shows the case that the door is opened by means of the inner lever 3, its nose 3.1 resting against the lever arm 1.22 and turning the pawl 1.3 into its open position.

In FIGS. 4A–4E, there is shown a further embodiment of a transmission device in accordance with the invention. In this case also there is again provided the inner lever 3 which, in the normal case, is brought out of engagement with the lever arm 1.22 of the pawl 1.3 and, in the event of a malfunction, can be operatively connected with it so that the door can be opened via the door inside handle and/or the door outside handle. In addition, a further Bowden cable 3.10 is shown which also has a core 3.12 which is pre-tensioned by a spring 3.11. In this case, the outer lever 2 is actuated via a closure cylinder while the inner lever 3 is connected with the door inside handle or door outside handle by the Bowden cables 3.4 and 3.10 or their cores 3.6 and 3.12 respectively.

In order that, upon actuation of the door inside handle or door outside handle, movement of the handles can take place independently of each other. A slide block 3.13 is provided which receives the ends of the cores 3.6 and 3.12 which are displaceable linearly, independently of each other, within this slide block. Around the pivot point 1.14 there is rotatably arranged an additional coupling element 1.41 which has a projection (nose) 1.42. The coupling element 1.41 is movable up to a stop 1.43. The inner lever 3 is mounted for displacement on a resting part 3.14, which is also swingable. At its upper end, the resting part 3.14 has, at its upper end, a pot 3.15 which contains a spring 3.16 which is pretensioned in the normal case. The resting part 3.14 is provided with a triangular recess 3.17 into which the projection 1.42 extends and is thus fixed in place.

Figures 4A, 4B, 4C, 4F:
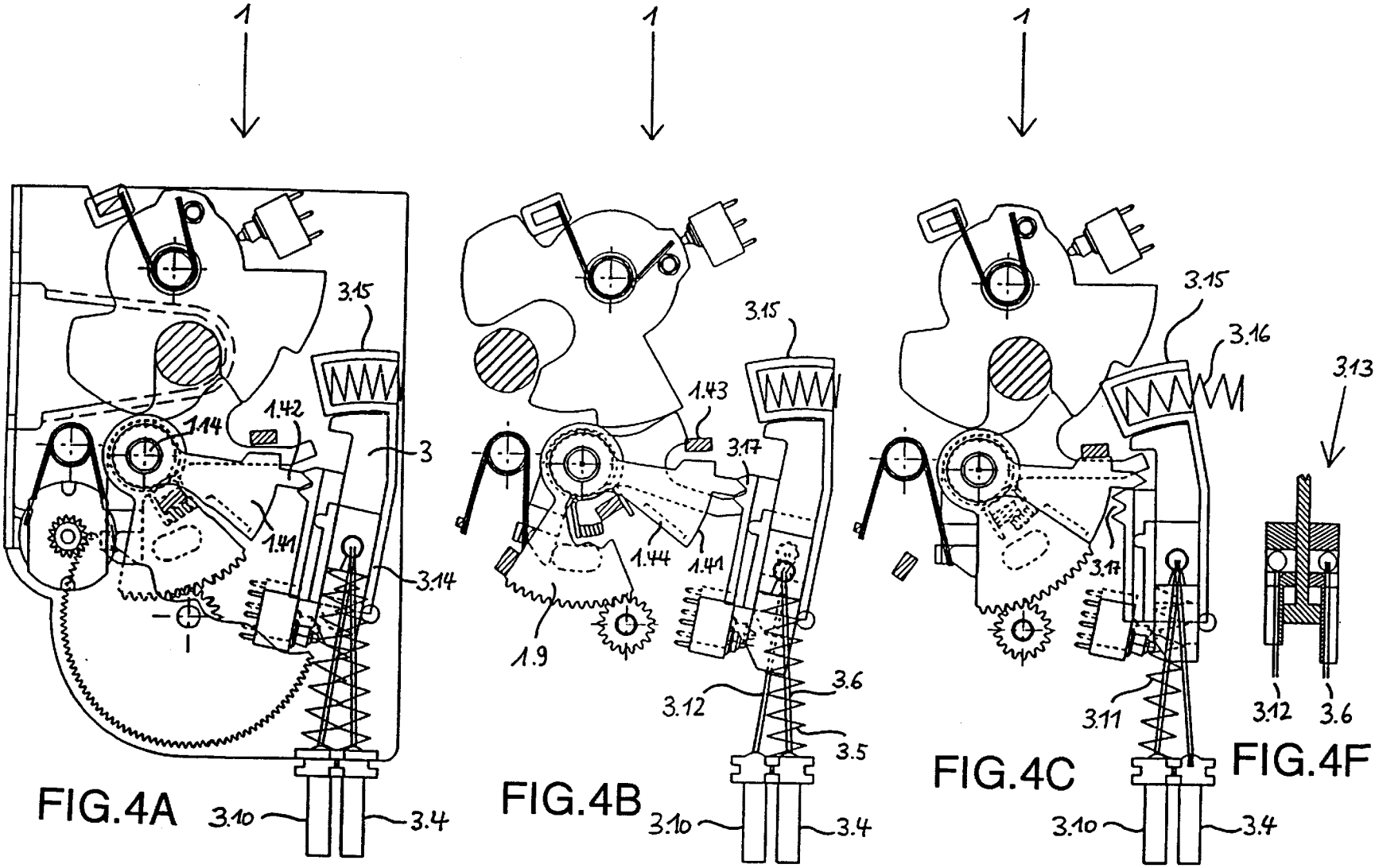
FIGS. 4A–4E show stages in the operation of a lock with mechanical redundancy in accordance with a second embodiment of the invention.
FIG. 4F is a detailed view of FIG. 4C.
Figure 4E:
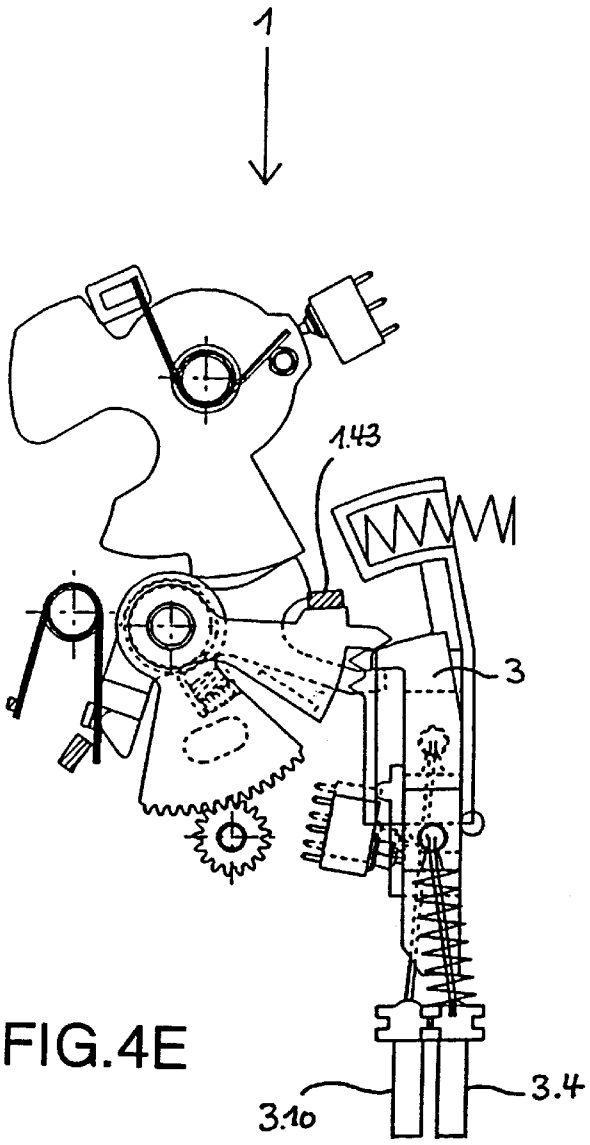
Figure 4D:
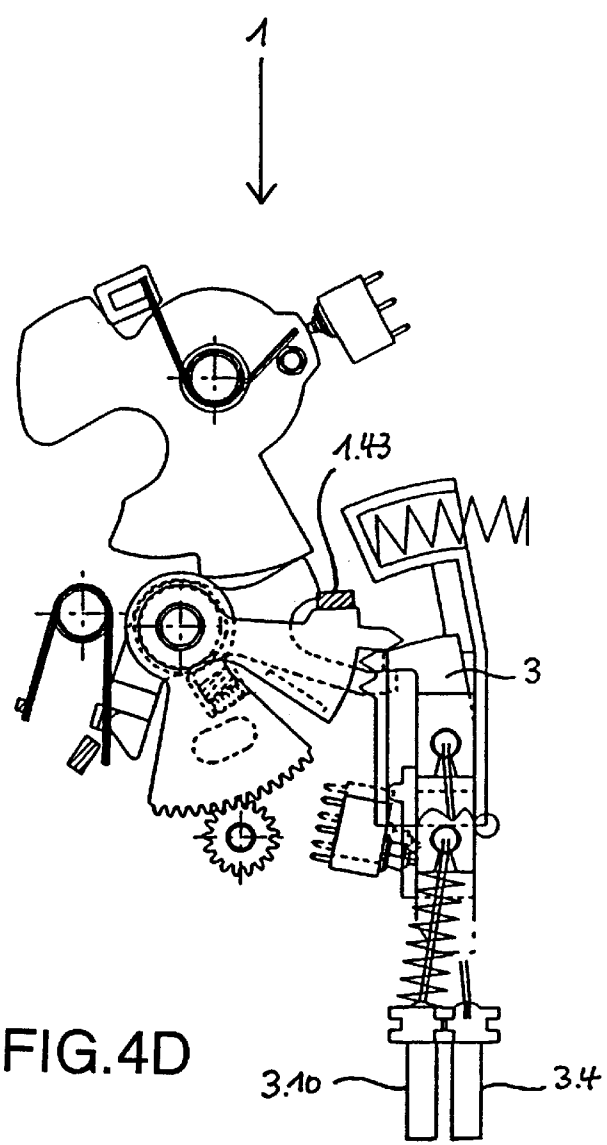

In the normal case, the rotary latch 1.1 is locked or released by the pawl 1.3. In these cases, the inner lever 3 is brought out of engagement with the pawl 1.3 by the interaction between the projection 1.42 and the triangular recess 3.17, so that the pawl is without action. If a malfunction occurs, which is recognized in suitable manner by the control device 10, the coupling element 1.41 is swung by the toothed segment 1.9, which then strikes against a stop 1.44 on the coupling element 1.41, into the position shown in FIG. 4C, so that the projection 1.42 is moved out of the triangular recess 3.17. In this way, the inner lever 3, together with its resting part 3.14, is brought in the direction of the pawl 1.3 so that the nose 3.1 of the inner lever 3 can be brought into operative connection with the lever arm 1.22. Thereby, in the event of this malfunction, the door can be opened by the door outside handle (FIG. 4D) or the door inside handle (FIG. 4E). The arrangement or the geometrical development of the projection 1.42 and of the triangular recess 3.17 are in this connection so selected that after the recognition of a malfunction and the corresponding swinging of the coupling element 1.41 (FIG. 4C), the position for the normal case (FIG. 4A or 4B) can again be established. A return into the normal position can, for instance, be effected by a spring which acts on the coupling element 1.44.

Figures 5D, 5E, 5F, 5G:
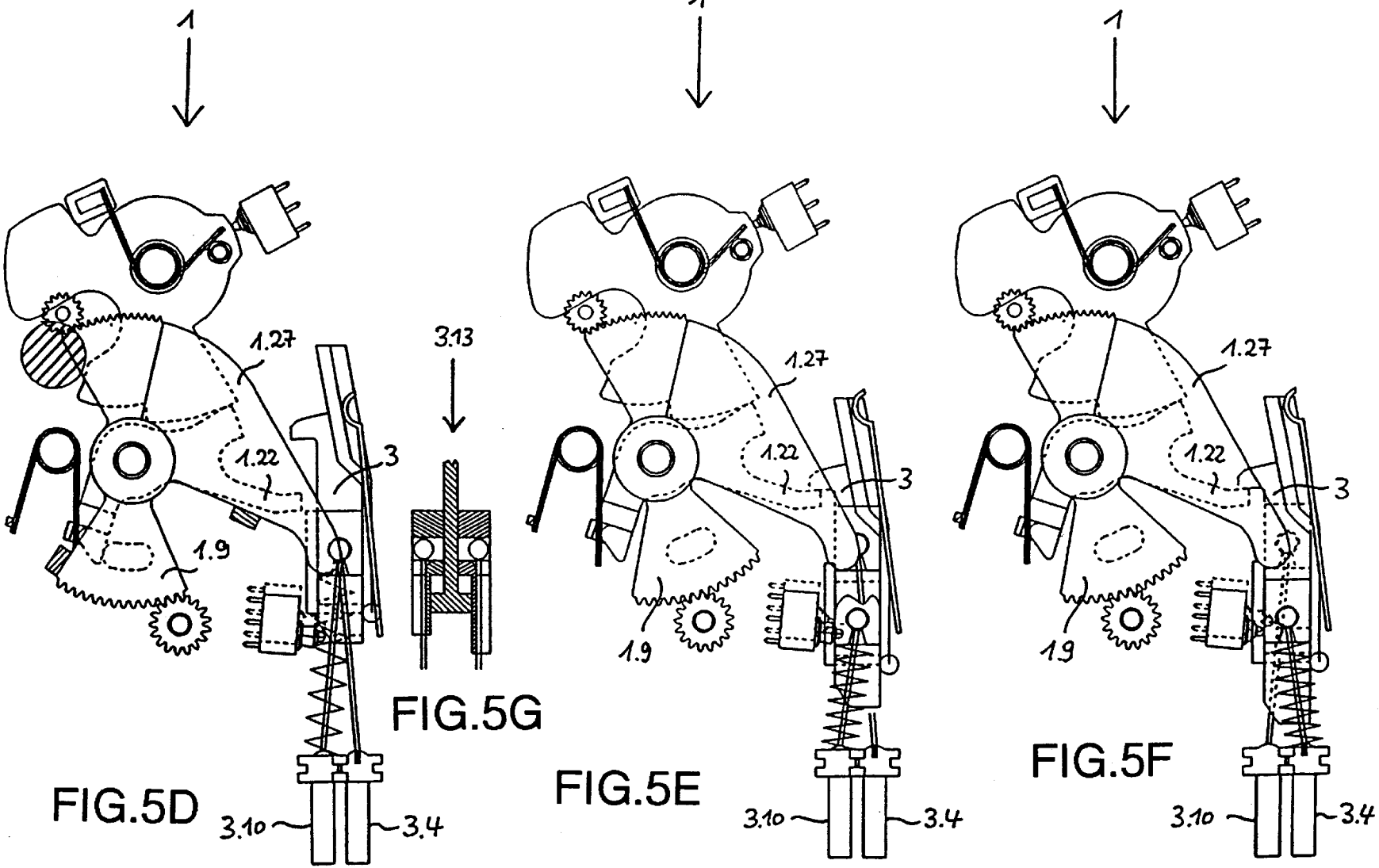

FIGS. 5A–5F show another embodiment in which a further electric motor 1.25 is provided which bears a pinion 1.26 on its output shaft. The electric motor 1.25 is connected to the control device 10 and actuated by it. Around the pivot point 1.14 there is arranged another swing lever 1.27 having a toothed segment 1.28 which has an arm 1.29. The toothed segment 1.28 meshes with the pinion 1.26. Stops 1.30 and 1.31 are provided in order to limit the movement of the arm 1.29. FIG. 5A shows the position that the inner lever 3 is brought out of engagement with the lever arm 1.22 by the arm 1.29 which again corresponds to an anti-theft position. In FIG. 5B, the electric motor 1.25 has been controlled in such a manner that the inner lever 3 can be brought into operative connection with the lever arm 1.22, but this has not yet been done. FIG. 5C shows, again in another view, the anti-theft position, while FIG. 5D shows that the pawl 1.3 has been moved by the electric motor 1.7 into its open position. The inner lever 3 is again connected via the cores 3.6 and 3.12 with the door inside handle or door outside handle, in which connection, here also, the slide block 3.13 is used. An emergency unlocking by actuation of the inner lever 3 which has been released by actuation of the door inside handle or door outside handle is shown in FIGS. 5E and 5F. In this connection, again, the inner lever 3 is moved downward, its nose 3.1 being brought against the lever arm 1.22 and thus moving the pawl 1.3 into its open position.

Figure 6:
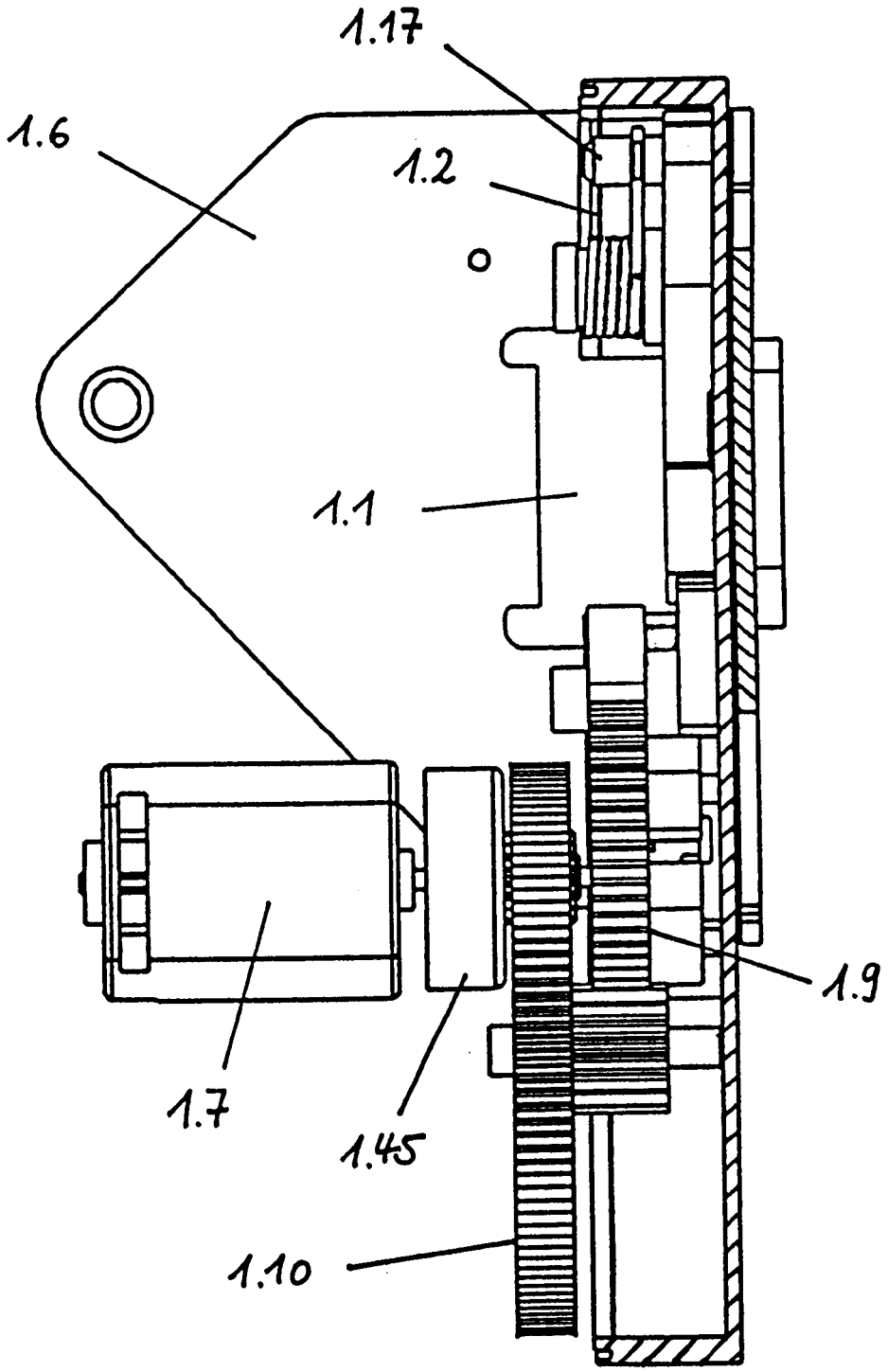
FIG. 6 is a cross section through a lock.

FIG. 6 is a cross section of the lock along the dashed line shown in FIG. 1A.

We claim:

1. A lock comprising:

a rotary latch, a locking wedge, a pawl, and a setting device; wherein the rotary latch engages with the locking wedge and is lockable by the pawl in a locking position of the lock, the pawl being actuatable by the setting device for bringing the rotary latch at least into one open position; and the lock further comprises transmission elements which transmit a movement of the setting device, in stepped-down fashion, to the pawl, the transmission elements being arranged between the pawl and the setting device;

wherein interconnections between successive ones of the transmission elements permit an opening movement of the transmission elements in response to a manipulator force applied to one of the transmission elements to release the pawl from engagement with the rotary latch;

the step-down transmission includes at least one gear wheel and at least a first toothed segment including means on said first toothed segment for contacting said pawl, and said setting device comprises an electric motor; and said at least one gear wheel is drivable by said electric motor and is operatively coupled to said first toothed segment for actuating said pawl.

2. A lock according to claim 1, the lock being suitable for locking a car door, wherein said transmission elements constitute a step-down transmission.

3. A lock according to claim 2, wherein said transmission further comprises a second toothed segment interconnecting said one gear wheel with said first toothed segment, said second toothed segment comprising first and second gear wheel means having respectively, first and second diameter;

said first diameter is larger than said second diameter; and said first gear wheel means having the larger diameter meshes with said one gear wheel, and said second gear wheel means having the smaller diameter meshes with said first toothed segment.

4. A lock according to claim 1, the lock being switchable for locking a car door, and further comprising:

a sensor for detecting a position of the rotary latch.

5. A lock according to claim 4, wherein said sensor is a switch.

6. A lock according to claim 3, wherein said pawl is urged by said first gear wheel means, which is movable by said setting device, for bringing said rotary latch into a predeterminable position prior to said one open position for enabling a two-stroke operation in an opening of the lock.

7. A lock according to claim 1, the lock being suitable for locking a car door, and further comprising a control device having command means for giving setting commands to the lock.

8. A lock according to claim 7, wherein said command means comprises an input device.

9. A lock according to claim 7, wherein said command means comprises at least one portable transmitter and a receiver coupled thereto.

10. A lock according to claim 9, wherein said command means further comprises an input device.

11. A lock according to claim 1, the lock being suitable for locking a car door, and further comprising:

a manipulator and an actuation-detection device operatively coupled to the manipulator for detecting actuation of the manipulator, said detection device and said manipulator constituting a structural unit.

12. A lock according to claim 11, wherein said actuation-detection device is a switch.

13. A lock according to claim 1, wherein said latch, said one gear wheel, said first toothed segment, and said pawl are rotatable about parallel axes, said pawl and said first toothed segment having a common axis of rotation, said actuating of said pawl by said electric motor occurring during only one direction of rotation of said first toothed segment.

14. A lock according to claim 1, wherein the latch has a recess for receiving the locking wedge, and a surface of the latch adjoining the recess serves to receive the pawl in a locked position of the latch.

* * * * *